United States Patent [19]

Caruth

[11] 3,996,959

[45] Dec. 14, 1976

[54] WASHER-CONNECTOR SERVICE BOX

[76] Inventor: Juanita W. Caruth, 3519 W. 78th, Prairie Village, Kans. 66208

[22] Filed: May 21, 1973

[21] Appl. No.: 362,223

[52] U.S. Cl. ..... 137/360; 52/221

[51] Int. Cl.[2] ..... F16L 5/00

[58] Field of Search ..... 4/191, 192; 52/221, 52/242; 137/360; 248/DIG. 6

[56] References Cited

UNITED STATES PATENTS

| | | | |
|---|---|---|---|
| 1,797,164 | 3/1931 | Tashjian | 52/221 |
| 1,906,670 | 5/1933 | Thomas | 52/221 |
| 1,911,407 | 5/1933 | Thomas | 52/221 |
| 2,832,080 | 4/1958 | Hertenstein et al. | 137/360 UX |
| 2,952,271 | 9/1960 | Dick et al. | 137/360 |
| 3,096,782 | 7/1963 | Williams | 137/360 |
| 3,146,298 | 8/1964 | Ceglia | 52/221 X |
| 3,148,698 | 9/1964 | Arnold | 137/360 |
| 3,175,575 | 3/1965 | Kennedy | 137/360 |
| 3,316,624 | 5/1967 | Brudevold | 52/221 X |
| 3,491,486 | 1/1970 | Caruth | 52/220 X |
| 3,718,154 | 2/1973 | Doumany | 137/360 |

OTHER PUBLICATIONS

Copy from Sweets Catalogue (1970), 2 pages.

*Primary Examiner*—Alan Cohan
*Assistant Examiner*—Gerald A. Michalsky
*Attorney, Agent, or Firm*—Richards, Harris and Medlock

[57] ABSTRACT

A wall fixture enclosure including a service box of a size to be recessed in a wall having top and sidewalls and a drain mounted in a partition extending between said sidewalls. Ports are formed in the sides of the box for receiving water pipes therethrough with a tap thereon. A face plate adapted for attachment over said box. A port formed in said face plate for allowing access and connection to said water pipes and said drain. An extension access plate with one end adapted for attachment to said box in an overlapping arrangement with said face plate and the other end thereof extending to the floor to allow the box to be mounted in said wall at various heights. A cover plate for releasably covering said port in said face plate.

3 Claims, 1 Drawing Figure

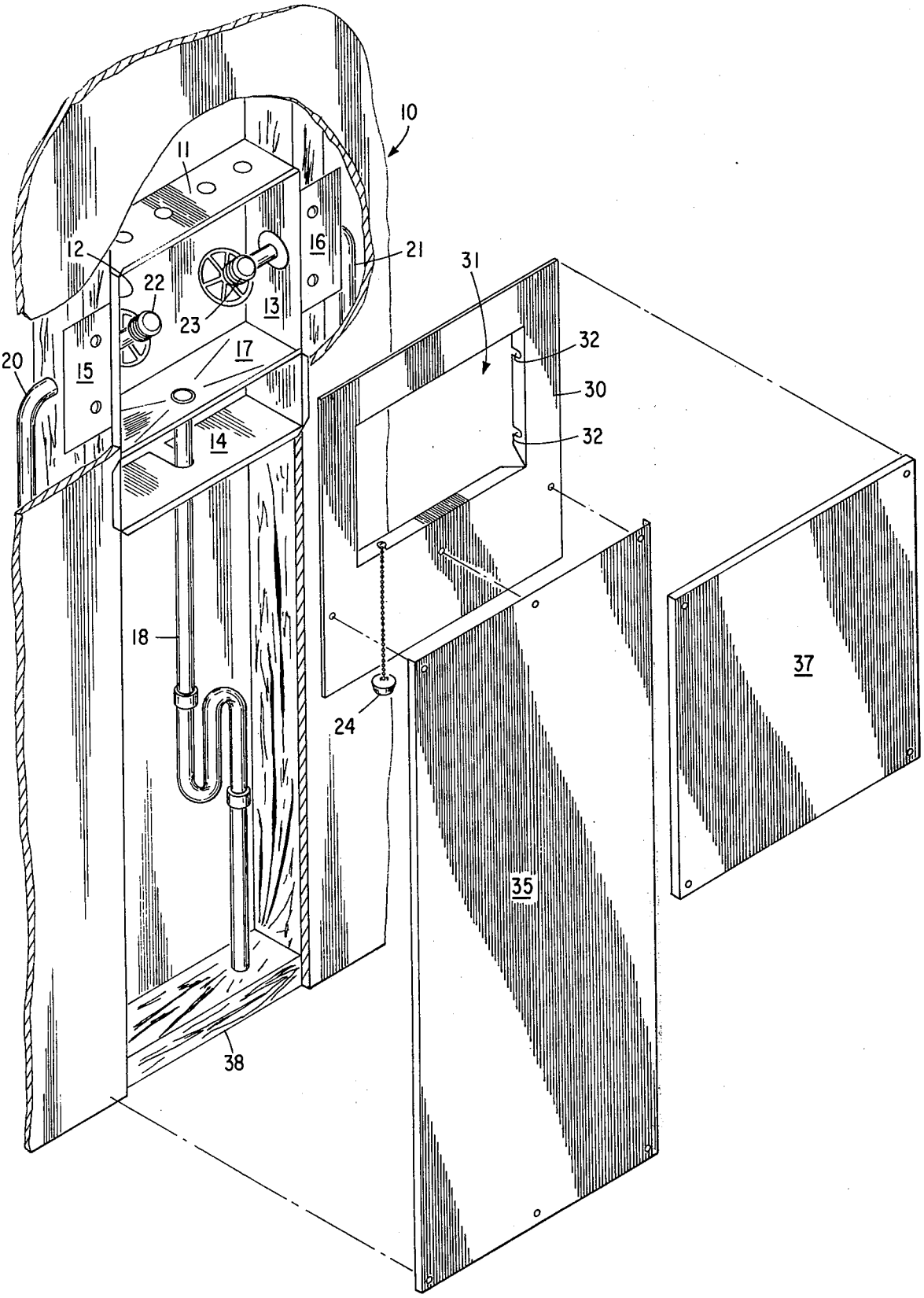
10
11
12
13
14
15
16
17
18
20
21
22
23
24
30
31
32
32
35
37
38

WASHER-CONNECTOR SERVICE BOX

This invention relates to washer-connector service boxes, and more particularly to a service box which is readily adaptable to accommodate various heights of the sites of utility service outlets.

Utility service for household appliances such as clothes washers requires access to hot and cold water lines and to a drain line. These normally are recessed in a four-inch nominal thickness wall.

In Applicant's prior U.S. Pat. No. 3,096,782, a utility service box with a recessed fitting and cover system has been described and claimed.

In providing such amenities in existing housing, it is often necessary to tear out and rebuild complete wall sections in order to install the utility service necessary for a clothes washer, for example.

The present invention is provided to minimize the intrusion into existing structures for the purpose of adding such utility services and for providing continued access to the connections after the date of installation.

In accordance with the present invention, there is provided a service box having top, side and bottom walls and a depth dimension adapting the same to be recessed in a wall structure. An intermediate partition is provided above the bottom wall recessed downwardly from each wall of the box and having a drain outlet centrally thereof. Ports are formed in the box on each side of the drain outlet, each port capable of receiving a water pipe therethrough with a tap thereon. An upturned flange is formed along the edges of the intermediate partition and means are formed on each side wall of the box for securing the same to a wall structure. A face plate having dimensions corresponding to the outer dimensions of the box is provided. This plate has a port therein to provide access to the interior of the box. An extension access plate of dimensions equal to the width of the box and of a height of the order of about 32 inches is provided along with a cover plate of dimensions corresponding with those of the face plate to allow the box to be mounted at various heights above a floor with the face plate and cover plate covering the box and an extension access cover plate extending from the floor and overlapping the bottom portions of the face plate, depending upon the height of installation of the box.

For a more complete understanding of the present invention, reference may now be had to the following description taken in conjunction with the accompanying Drawing in which:

FIG. 1 is an exploded perspective view of a preferred embodiment of the present invention.

Referring now to the Drawings, there is illustrated a water tap and drain receptacle box 10 for installation in a wall structure which comprises a rectangular box having a top wall 11, side walls 12 and 13 and a bottom wall 14. The walls 11 through 14 have outturned flanges thereon.

Attachment wings or brackets 15 and 16 are secured on opposite sides of box 10 to facilitate securing the same to suitable studs of a wall structure. For example, the box could have a depth dimension adapting the same to be recessed in a wall structure such as normally formed by 2 × 4 studs spaced on 16-inch centers.

A drip pan or intermediate partition 17 extends horizontally across the box of the order of 6 inches above the bottom wall 14. The partition 17 is recessed downwardly from each wall of box 10 and has a drain outlet connected to a drain pipe 18. The bottom wall 14 is notched centrally from the rear thereof in order to accommodate the drain pipe 18. The sidewalls 12 and 13 have lateral ports through which water supply lines 20 and 21 are connected to faucets 22 and 23. In a preferred form, the top wall 11 has a plurality of spaced apart preformed knockouts to accommodate entry into the box 10 of water lines through top wall 11. In addition, these knockouts can allow the discharge of condensate drainage from air conditioning units or the like.

A face plate 30 is provided of dimensions corresponding with the outer dimensions of the outturned flanges on box 10. Face plate 30 is adapted to be secured to the box 10 to cover the same completely. In one embodiment, it was 14¾ inches wide and 16 inches high. Thus, when in place, it covers both the compartment above and the compartment below the intermediate partition 17.

A rectangular port 31 is formed in the face of panel 30 in order to permit access to the faucets 22 and 23 and for a passageway through which a drain leading from a washer may pass and be inserted into the drain pipe 18. Flanges are formed around the periphery of the port 31 and slots 32 are formed in the vertically extending flanges for attachment of the plate 30 in place. A plug 24 is attached to plate 30 by means of a small chain to allow sealing of the drain 18 when not in use.

An extension access plate 35 is provided to extend from a point above the bottom of plate 30 to the floor level. This extension plate 35 is preferably of the order of 32 inches in height and the same width as plate 30. This extension plate 35 is provided in order to accommodate differences in the heights at which the box 10 may be mounted. A cover plate 37 is provided with dimensions the same as plate 30 to cover the port 31 when the box 10 is not in use.

The box 10 may be mounted at a 30 inch height or a 36 inch height, depending upon the specifications or the practices followed by the installer. This mounting is accomplished by fastening the brackets 15 and 16 to the wall studs. The plate 30 is then installed on the box 10 by means of suitable fasteners (not shown) and slots 32. These slots 32 allow the use of the plate 30 with various thicknesses of wall paneling. Next, the extension plate 35 is installed over the opening in the wall providing access to the trap in drain pipe 18. The lower end of the extension plate 35 is attached to the sole plate 38 of the wall adjacent the floor while the upper end will overlap and is attached to a portion of the plate 30. This overlap allows the assembly to be used in all installations where the height of the drain is between 32 and 36 inches from the floor. The cover plate 37 can then be used to cover face plate 30 when the box 10 is not in use.

To install the utility box 10 in a previously constructed dwelling, it is only necessary to make a cutout in the wall board between two studs and insert the box 10, apply the face plate 30 and thereafter apply the extension plate 35. This permits ready access to the trap and the drain pipe 18 for service operations and minimizes to a maximum degree the intrusion into existing walls for such an installation as herein described. When desired, if the unit is not in use or is initially installed, the cover plate 37 can be installed to provide a complete cover for the entire installation which may be readily removed in order to permit connections to a washer when the washer is brought into place to be connected.

Various modifications are contemplated and may obviously be resorted to by those skilled in the art without departing from the spirit and scope of the invention, as are hereinafter defined in the appended claims, as only a preferred embodiment thereof has been disclosed.

I claim:

1. In a water service box for installation in a wall structure and for connection to taps and drains mounted at various heights in said wall structure, the combination which comprises:

a. a rectangular box having top and side walls, the dimension thereof being such as adapting the same to be attached to said wall structure in a recessed position at various heights, said box having ports capable of receiving a water pipe therethrough having a tap thereon, b. a horizontal partition attached to and extending between said sidewalls and being recessed downwardly from each wall of said box and having a drain outlet centrally thereof and an upturned flange formed along the front edge of said horizontal partition, c. a face plate removably connected to said box having a port therethrough for passage of hoses to connect to said water tap and for passage therethrough of a line leading to said drain, said plate having a lower portion extending to the lower edge of said box, and (d) an extension access plate removably connected to said face plate, said access plate removably secured to said wall structure to cover an opening providing service access to the drain and covering varying portions of said face plate depending upon the height said box is attached in said wall structure.

2. A combination as defined in claim 1 additionally comprising a cover plate releasably attached to said face plate and being of a size to cover the port in said face plate.

3. A combination as defined in claim 1 wherein flanges are formed on said face plate along the periphery of said port, said flanges having slots formed therein for attaching said face plate to said box.

* * * * *